US007797768B2

(12) United States Patent
St. John

(10) Patent No.: US 7,797,768 B2
(45) Date of Patent: Sep. 21, 2010

(54) TOILET SPLASH GUARD

(76) Inventor: Thomas E. St. John, 430 George St., Elgin, IL (US) 60120

( * ) Notice: Subject to any disclaimer, the term of this patent is extended or adjusted under 35 U.S.C. 154(b) by 67 days.

(21) Appl. No.: 12/380,027

(22) Filed: Feb. 23, 2009

(65) Prior Publication Data

US 2010/0024110 A1 Feb. 4, 2010

Related U.S. Application Data

(63) Continuation-in-part of application No. 12/221,523, filed on Aug. 4, 2008.

(51) Int. Cl.
*E03D 9/00* (2006.01)

(52) U.S. Cl. ..... 4/300.3; 4/255.01

(58) Field of Classification Search ..... 4/300.3
See application file for complete search history.

(56) References Cited

U.S. PATENT DOCUMENTS

| | | | | |
|---|---|---|---|---|
| 3,935,134 | A | 1/1976 | Bassett | |
| 3,939,003 | A | 2/1976 | Grgach | |
| 3,969,176 | A | 7/1976 | Bassett | |
| 4,036,676 | A | 7/1977 | Pennington | |
| 4,267,005 | A | 5/1981 | Barnaby | |
| 4,458,368 | A | 7/1984 | Webb | |
| 4,461,662 | A | 7/1984 | Onishi | |
| 4,649,575 | A * | 3/1987 | Blair et al. | 4/245.5 |
| 4,678,832 | A | 7/1987 | Pospich | |
| 5,922,805 | A | 7/1999 | Bouttefort | |
| 6,487,730 | B2 | 12/2002 | Pardo | |
| 6,582,762 | B2 | 6/2003 | Fiassat | |
| 6,590,063 | B2 | 7/2003 | Poessnecker | |
| 6,594,831 | B1 | 7/2003 | Pardo | |

* cited by examiner

*Primary Examiner*—Charles Phillips
(74) *Attorney, Agent, or Firm*—Donald Pochopien

(57) ABSTRACT

The present invention is directed a splash guard for containing the contents of a toilet during plunging, comprising: a substantially ovular pliable shield having a top side, a bottom side, a peripheral edge and a blunted posterior end, the pliable shield having a size from 5-20% greater than the size of said toilet seat; a drape member having an upper edge, a bottom edge, and a distance between the upper edge and said bottom edge of 3 to 8 inches; and a resilient element; the top edge of the drape member circumferentially affixed to the peripheral edge of the pliable shield at a seam, the resilient element being tensioned and operatively affixed along the length of the seam but optionally the elastic element not being affixed to the seam at the blunted end; the pliable shield further having a minor opening sized and positioned for slideably receiving a plunger handle, whereby when the splash guard is positioned on the underside of the toilet seat and the resilient element is stretched outwardly, and then upwardly to engage the top of the toilet seat, the top of the pliable shield covers the bottom of the toilet seat and is held in position by the tension in the resilient member, and when the toilet seat is in the down position, the drape member drapes down sufficiently into the toilet bowl and in proximity to the rim so as to shield the rim from receiving splashes or waste during plunging with the plunger.

20 Claims, 5 Drawing Sheets

TOILET SPLASH GUARD

CLAIM OF PRIORITY

This application is a continuation-in-part of U.S. patent application Ser. No. 12/221,523, filed Aug. 4, 2008, the entirety of which is hereby incorporated by reference.

FIELD OF THE INVENTION

The present invention is in the field of disposable sanitation devices. More particularly, the present invention is in the field of disposable splash guards for use during the plunging of a toilet bowl. The present invention is useful because it provides a barrier that prevents substantially all of the waste and water from exiting the bowl while using a plunger therein.

BACKGROUND OF THE INVENTION

U.S. Pat. No. 4,458,368, entitled "Plunger with Anti-Splash Shield," issued to Webb on Jul. 10, 1984. The '368 patent teaches a device for preventing splashing during plunging that comprises a circular or oval shield having an resilient means for expanding the shield to sealably engaging the toilet bowl under the rim. The resilient means is disclosed as an expandable band of steel or plastic. ['368 at col. 2, lines 48-50.] It is also preferably molded within the outer edge of the shield. ['368 at col. 2, lines 48-50.] The shield on this device also has a centrally positioned hole for slideably engaging the shaft of the plunger during plunging. A problem with this device is that it requires contact with the bowl to position the shield. Another problem is that the resilient means requires a large piece of packaging to accommodate the resilient means, which means that it requires more storage space until needed.

U.S. Pat. No. 6,487,730, entitled "Anti-Splash Guard" issued to Pardo, et al., on Dec. 3, 2002. The '730 patent teaches a splash guard comprising a circular shield having an upper opening for slideably receiving the shaft of a plunger and a lower opening having a periphery with a continuous elastic element 50 disposed adjacent thereto for receiving a portion of the outside surface 52 of the toilet bowl. A problem with guard of the '038 patent is that the elastic will tend to cause the guard to slip back where it is adjacent the seat and unable to grab any outside surface. As the outside shape of the bowl becomes less round or less indented toward the toilet seat, the tendency to slip increases. Also, because the shield of the '730 patent overlaps the outside of the bowl, water and waste that is splashed up along the top edge of the bowl would leak over the side of the bowl and onto the floor. An object of the present invention is to provide a splash guard for use during plunging that would seat firmly onto a toilet and that substantially prevents any splashes from running down the outside surface of the toilet bowl.

U.S. Pat. No. 6,594,831, entitled "Anti-Splash Guard" issued to Pardo, et al., on Jul. 23, 2003. The '831 patent teaches a splash guard in FIGS. 4-7 comprising a solid sealed surface that is sized and shaped to cover the outside of the toilet bowl and that has a further extension to accommodate a plunger handle and plunger bulb operatively positioned inside of the toilet bowl. The splash guard of the '831 patent further comprises a bulbous pocket built in the front for catching effluent. One problem with the splash guard of the '831 patent is that it hangs over the outside of the toilet, such that any waste water that splashes over the rim of the toilet during plunging will run down the side of the toilet and leak onto the floor. Another problem with the splash guard of the '831 patent is that it contains the handle of the plunger on the waste side of the splash guard such that the handle will become contaminated during use and require substantial cleaning. Also, because the splash guard and the plunger are subject to substantial movement during plunging, the movement may cause the splash guard to slip back allowing water and waste to further elude containment. Therefore, it is an object of the present invention to provide a shield that isolates the gripping portion of the plunger handle from direct contact with the waste and waste water in a plugged toilet. A further object of the present invention is to provide a splash guard that substantially prevents waste water from running down the outside surface of the toilet bowl during plunging.

SUMMARY OF THE INVENTION

The present invention has multiple embodiments. In particular, the present invention is directed to a disposable toilet splash guard for use in controlling the splashing of water and contents during the plunging of a toilet that is plugged and unable to expel its contents. The present invention is for use with a conventional toilet, having a toilet bowl, a rim, and a seat, and a conventional plunger comprising an elongated handle having a plunger bulb operably positioned at one end. In its first embodiment, the present invention is directed to a splash guard comprising a pliable shield having a top side, a bowl side, an upper opening, a lower opening, a resilient (e.g., elastic) element and a drape member, the upper opening having a periphery sized and shaped for receiving the underside of a toilet seat, the resilient element disposed along the periphery, or a substantial portion of the periphery, for retaining the pliable shield against the toilet seat by expansively overlapping with a portion of the toilet seat, thereby retaining the splash guard in position relative to the toilet seat, whereby when the toilet seat is in a down position, the top side of the pliable shield faces up and the bowl side faces the toilet bowl. The lower opening is sized for slideably receiving the elongated handle of the plunger, the drape member attached in proximity to the periphery and when the toilet seat is down, draping sufficiently into the toilet bowl so as to shield the rim from receiving splashes or waste during plunging with the plunger.

In another embodiment, the pliable shield and resilient element of the present invention are sized and shaped for reversibly engaging the toilet seat but not the toilet bowl. The toilet seat is typically ½ inch to ⅔ inch thick and the splash shield need only overlap a portion of the upper surface of the toilet seat so that the resilient element can partially retract to hold the pliable shield up against the bottom surface of the toilet seat.

A problem with at least one of the prior art anti-splash guards is that after use, the dirty splash guard has to be slid up and over the elongated plunger handle to be discarded. This removal transfers unsanitary waste directly to the plunger handle. Another object of the present invention is to eliminate the unsanitary removal of the splash guard over the top of the plunger handle. Thus, in another embodiment, the splash guard of the present invention has a tear strip that allows one to widen the lower opening (used by the plunger stick) beyond the width of the plunger bulb to allow a used splash guard of the present invention to be positioned over a rubbish container, the tear strip engaged such that the splash guard drops into the rubbish container without further contaminating the plunger handle.

In yet another embodiment, the splash guard of the present invention comprises a substantially ovular pliable shield having a slightly larger size than that of a conventional toilet seat.

The ovular pliable shield is joined along its entire outer edge to the top edge of a gathered drape member of a predetermined length. The joined edges form a seam. The seam at the front and lateral edges of the seam incorporates a resilient element (e.g., rubber band, elastic band or elastic string) for placing tension on the front and lateral edges of the seam. Preferably, the resilient element is tensioned while being incorporated on or into the seam. The posterior ½ to ⅓ of the pliable shield also contains a minor opening shaped and sized for slideably accommodating a plunger handle. In use, this embodiment of splash guard is positioned on the underside of a toilet seat and its edges with the resilient element stretched over the top of the toilet seat such that the tensioned resilient element pulls together on the under side of the toilet seat allowing the gathered drape member to hang down into the toilet bowl when the toilet seat is in its lowered position. Prior to lowering the seat, one skilled in the art would typically insert the plunger handle up through a posteriorly positioned minor opening from the bowl (bottom) side of the pliable shield. In operation, the shielded toilet seat with the inserted plunger is lowered to the seat's full down position, and one begins plunging the toilet in a conventional manner until any obstructions are dislocated and flow is resumed. During plunging, the pliable shield prevents splashes and debris from being ejected up and outside the toilet bowl onto a person or floor, while allowing the person, who is performing the plunging, to observe what is occurring inside the toilet bowl. The drape member shields the toilet bowl rim from splashes and debris that could otherwise splash up and over the rim during plunging. Preferably, this embodiment, like all embodiments of the present invention, has a tear tab and tear strip to facilitate the separation of the plunger from the soiled splash guard after the latter's use.

DETAILED DESCRIPTION OF THE INVENTION

Figure 1:
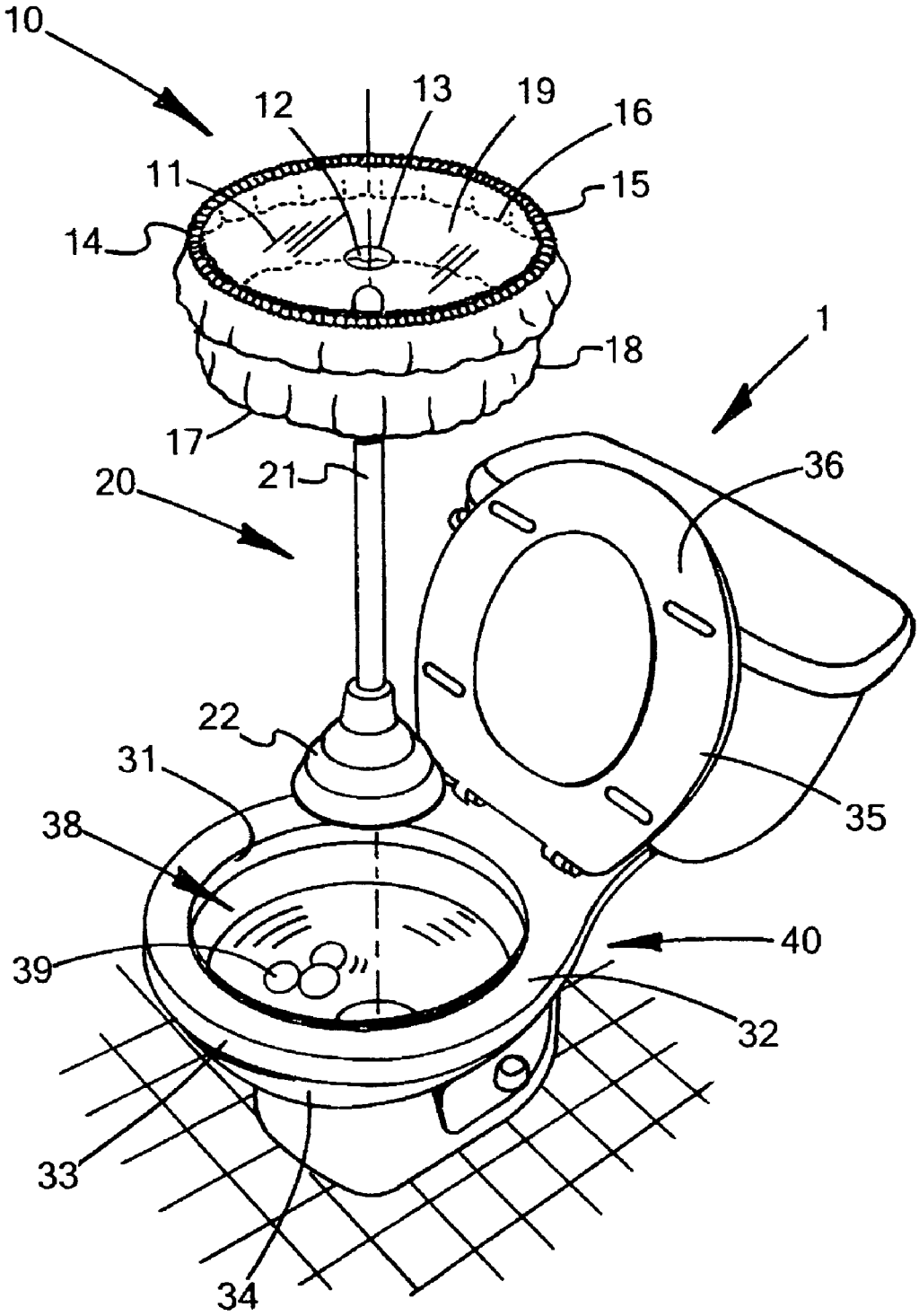
FIG. 1 is a perspective exploded view of one embodiment of the splash guard of the present invention in combination with a toilet and a plunger. The splash guard is sized and shaped for mounting over the under side of a toilet seat and has a substantially circumferential drape member extending therefrom for preventing splashing water and waste from accessing the toilet rim.
Figure 2:
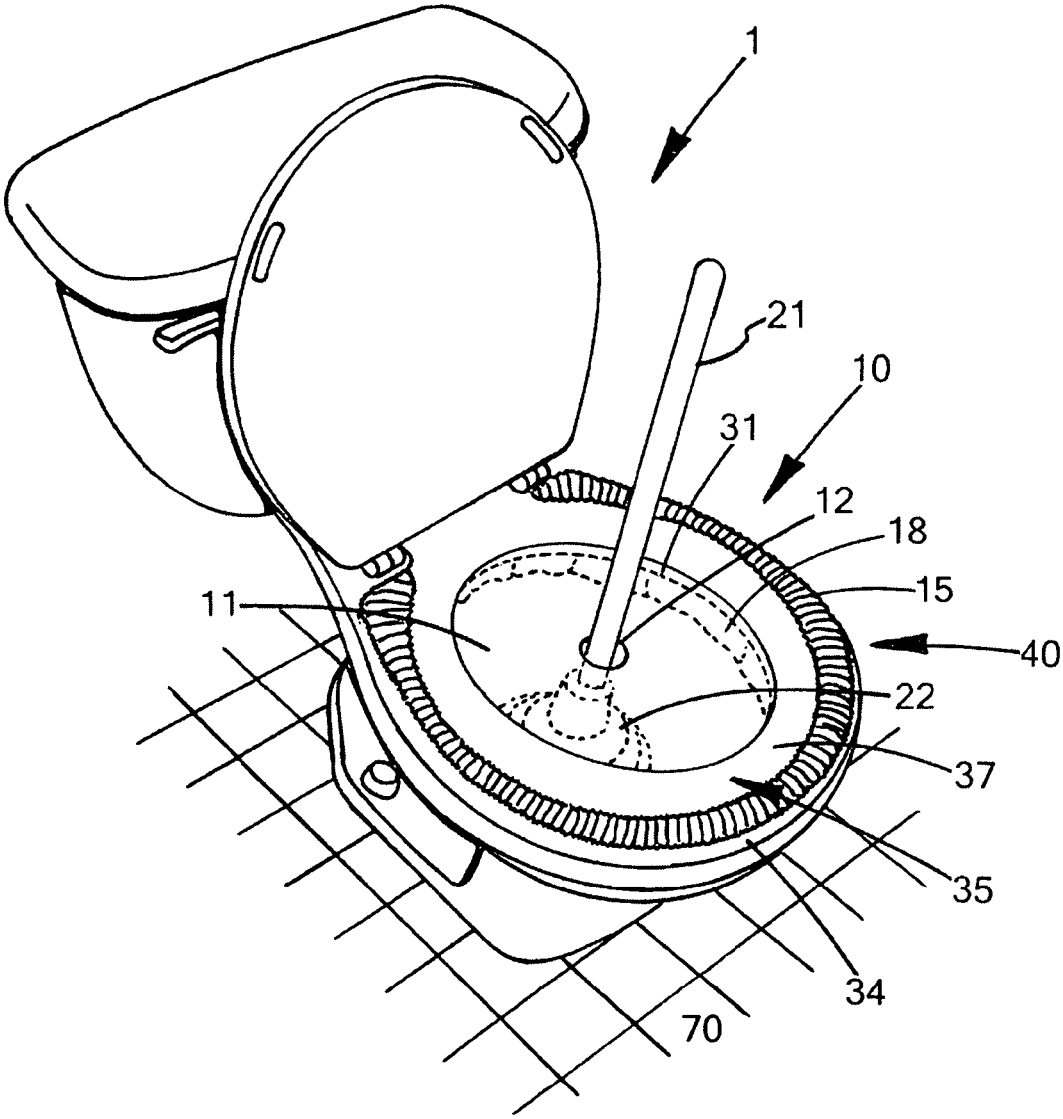
FIG. 2 discloses a side view of one embodiment of the splash guard of the present invention operatively positioned on a toilet seat with its drape member circumferentially draping over the inner rim of the toilet and into the bowl, thereby preventing splashes of water and waste from having access to the top rim and the ability to flow down the toilet's outside surface and onto the floor.
Figure 3:
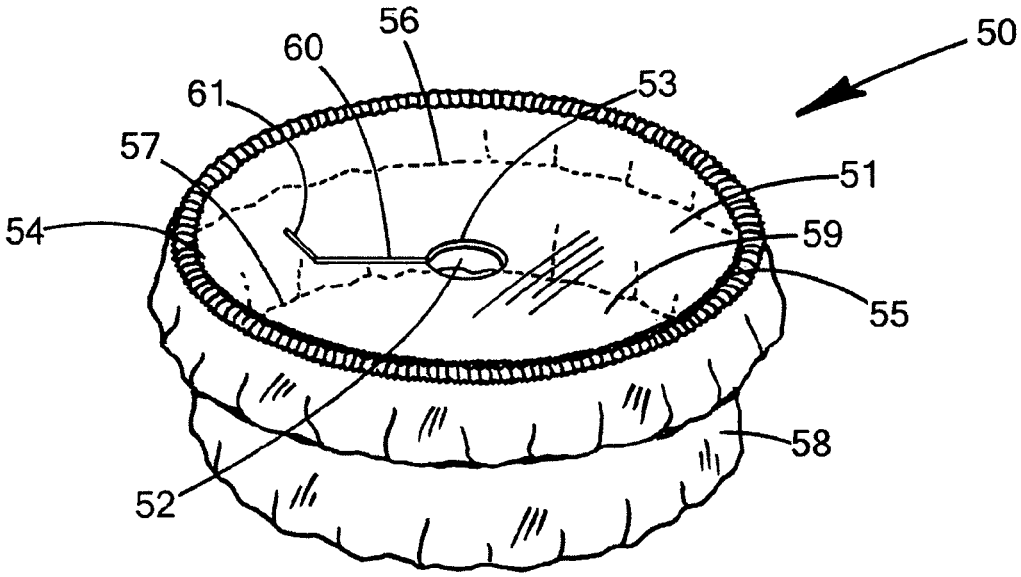
FIG. 3 discloses an alternate embodiment of the splash guard of the present invention, having a tear strip that allows the enlargement of the minor opening whereby the soiled splash guard can be separated from the plunger and dropped into a waste receptacle without contaminating the upper plunger handle.

The present invention is directed to a sanitary device for use with a plugged toilet that is unable to wash away water and waste after flushing. More particularly, the present invention is used with a typical flush toilet that has as components, a toilet bowl, a toilet seat and a toilet rim at the top of the toilet bowl. The present invention has multiple embodiments as shown in FIGS. 1-4 and as further disclosed herein. In one embodiment, the present invention is directed to a splash guard, as shown in FIGS. 1-3, for mounting on the underside of a toilet seat during plunging of the bowl of a plugged toilet with a typical plunger having an elongated handle and a plunger bulb. The splash guard comprises a pliable shield having a top side, a bowl (under) side, an upper opening, a lower minor opening, an resilient element and a drape member, the upper (major) opening having a periphery sized and shaped for receiving the underside of a toilet seat, the resilient element disposed along the periphery for enveloping the underside of the toilet seat by overlapping with a portion of the upper side of the toilet seat, thereby retaining the splash guard in position relative to the toilet seat, whereby when the toilet seat is in a down position, the top side faces up and the bowl side faces the toilet bowl. The lower (minor) opening is sized for slideably receiving the elongated handle of the plunger. The drape member is attached in proximity to the periphery of the splash shield, such that when the toilet seat is down, the drape member drapes sufficiently into the toilet bowl so as to shield the rim of the toilet bowl from receiving splashes of water or waste during plunging of the toilet bowl with the plunger. The embodiment of FIG. 4 differs from that of FIG. 1 in that the top edge of the drape member is joined to the peripheral edge of the pliable shield at a seam incorporating a resilient element along a substantial portion of the seams length.

In all the splash guards of the present invention, the pliable shield is typically made of a water resistant pliable material. Preferably, the pliable shield is made of a pliable polymeric material. In a preferred embodiment, the pliable polymeric material is clear (i.e., transparent). The clarity allows one to see through the polymeric material and monitor events while plunging the toilet bowl with the splash guard in place. Suitable polymeric materials are well known in the art. Examples of pliable polymeric materials are polyesters (e.g., biaxial oriented polyethylene terephthalate), or polyethylene (PE), polypropylene (PP), and mixtures of PE and PP. Preferred pliable polymeric materials are polyethylene, polypropylene, and mixtures thereof. These polymeric materials are commercially available in thin film sheets ranging in thickness from 0.5 mils to 5 mils. Any of these thicknesses would be suitable for use in the invention. Preferably, the thickness of the film used in the splash guard ranges from 1-5 mils; more preferably from 1-4 mils; most preferably about 2 mils (i.e., 2±0.1 mils). A preferred polymer film is a 2 mil polyethylene film.

In the splash guards of the present invention, the drape member is made of the same or a different polymeric material than the pliable shield. Preferably, it is made of the same polymeric material as used for the pliable shield. The drape member can be the same thickness as the pliable shield or different. Preferably, it is the same thickness. However, the drape member cannot be so thick as to fail to drape (hang) when the splash guard is mounted to the underside of a toilet seat and the seat is in the down position. Preferably, the thickness of the film used in the splash guard ranges from 1-5 mil; more preferably from 1-4 mils; most preferably most preferably about 2 mils (i.e., 2±0.1 mils). A preferred polymer film is a 2 mil polyethylene film. The drape member is attached to the bottom of the pliable shield near its periphery. For the embodiment of FIGS. 1 and 3, the drape member is attached to the underside of the pliable shield from 1 inch to 3 inches from the widest edge of the mounted splash guard. More typically, the drape member is attached from 1 inch to 2 inches from the widest edge of the mounted splash guard. The above distances from the widest edge, allow the drape member to drape near or over the inside rim of the toilet bowl so as to shield the inside rim of the toilet bowl from receiving splashing water and waste during plunging, thereby preventing splashing water or waste from reaching the top rim of the toilet bowl. Water and waste that does not reach the top rim of the toilet bowl cannot spill over the toilet bowl rim and onto the floor. For the embodiment of FIG. 4, the drape member 88 is attached to the peripheral edge 84 of the splash shield 79 at seam 85 and needs to be 2 inches longer than the shield of FIGS. 1 and 3.

Various well known methods are useful in the present invention for attaching the drape member to the pliable shield. In one embodiment, the drape member is attached by fusing one edge of the drape member to the bottom surface of the pliable shield using high frequency electrical energy (heat sealing). Methods and devices for heat sealing films are well known in the art. See e.g., U.S. Pat. No. 3,969,176 (Bassett), entitled "Method for Heat Sealing Polyester Film," which issued Jul. 13, 1976; U.S. Pat. No. 4,036,676 (Pennington), entitled "Heat Sealing of Plastic Sheets," which issued Jul. 19, 1977; and U.S. Pat. No. 4,267,005 (Barnaby), entitled "Heat Sealing Apparatus," which issued May 12, 1981; all of which are incorporated herein by reference for their specific disclosure of a method and device for heat sealing of plastic films. In another embodiment, the drape member is attached to the bottom of the pliable shield by using the well-known technique of ultrasonic welding. Methods and devices for effecting ultrasonic welding are well-known in the art. See, e.g., U.S. Pat. No. 4,461,662 (Onishi), entitled "Ultrasonic Welding Apparatus," which issued Jul. 24, 1984; and U.S. Pat. No. 3,939,033 (Grgach), entitled "Ultrasonic Welding and Cutting Apparatus," which issued Feb. 17, 1976; all of which are incorporated herein by reference for their specific disclosure of a method and device for the ultrasonic welding of plastic films. A third method for attaching the drape member to the bottom of the pliable shield is applying a third material, such as an adhesive. Suitable adhesives for adhering plastic films are well-known in the art. Examples of adhesives include heat sealing adhesives (see U.S. Pat. No. 3,935,134 (Bassett), entitled "Heat Sealing Adhesives," which issued Jan. 27, 1976), hot-melt adhesives, methylmethacrylate, and the like. The term "hot melt adhesive" as used herein also includes the application of heated polyolefins such as PE or PP. Examples of suitable hot melt adhesives are found in the following U.S. Pat. No. 6,590,063 (Poessnecker), entitled "Low-Melting Copolyamide and their use as Hot-melt Adhesive," which issued Jul. 8, 2003; U.S. Pat. No. 6,582,762 (Fiassat), entitled "Sprayable Hot-melt Adhesives," which issued Jun. 24, 2003; U.S. Pat. No. 5,922,805 (Bouttefort)," entitled "Poly-urethane-based Single-component Hot-melt Adhesives with Improved Initial Cohesion," which issued Jul. 13, 1999; U.S. Pat. No. 4,678,832 (Pospich), entitled "Hot-melt Adhesives of Partially Saponified Vinyl Ester Copolymers," which issued Jul. 7, 1987, all of which are incorporated herein by reference for their specific disclosures of hot-melt adhesives and their method of application.

When the splash guard is operatively mounted (see e.g., FIG. 2) to the underside of a toilet seat and the toilet seat is in the down position, the drape member has sufficient length to drape into the toilet bowl and shield the inside rim (and/or the top rim) of the toilet bowl from splashes of water and waste that occur in the toilet bowl during plunging. Typically, the drape member has a length within the range of 1 to 8 inches; more typically, the drape member has a length within the range of 2 to 6 inches; most typically, the drape member has a length within the range of 2 to 4 inches. For the embodiment of FIG. 4, the drape member is longer at the low end of the range due to positioning and typically has a length of 3 to 8 inches; more typically, 4 to 8 inches; most typically, 4 to 6 inches.

In a preferred embodiment, the pliable shield of the splash guard further comprises a tear strip that is in substantial proximity to said lower opening. The function of the tear strip is allow the removal of the plunger head from a used splash guard without having to slide the used splash guard over the clean handle. The tear strip can tear in either direction. More preferably, the tear strip ends at the lower opening. The tear strip should be sufficient length to allow the removal of the plunger head from the splash shield-plunger combination. After use, the plunger-splash guard combination is placed over a waste receptacle. The tear strip is torn to enlarge the bottom hole to a size sufficient to slip over the plunger head and fall into the waste receptacle. Typically, the tear strip ranges in length from 3.5 inches to 8 inches. More typically, the length of the tear strip ranges in length from 4 inches to 7 inches. Although the tear strip could be longer, the additional length would provide no additional advantage. Optionally, the tear strip is colored to facilitate finding it on a used splash guard.

In the splash guard of the present invention, the lower opening can be positioned substantially centered on the pliable shield or it can be positioned off-centered to accommodate the two different toilet bowl configurations. Also, the shape of the lower opening can vary so long as the lower opening is not so large as to allow water and waste to splash up and out the opening during plunging of a plugged up toilet bowl. Suitable shapes for the lower opening are a slit, an oval, an ellipse (elliptical), or a circle (circular). Preferred shapes for the lower opening are an oval, elliptical or circular. The most preferred shape is circular. When the lower opening is circular, it has a preferred diameter ranging from 0.5 inches to 1.5 inches. The size of the lower opening varies depending upon the diameter of the plunger handle. To prevent any splashing of water or waste from exiting through the lower opening, the opening preferable slideably engages the elongated handle of the plunger during plunging. Traditionally, the conventional plunger has an elongated handle with a circular cross-section of 1 inch to 1.25 inches.

Examples of some of the embodiments of the present invention are provided in FIGS. 1-3 herein. FIG. 1 is a perspective exploded view of one embodiment of the splash guard 10 of the present invention in combination with a toilet 1 and a plunger 20. The toilet 1 has in relevant part a bowl 40 having an inside rim 31, a top rim 32, an outside rim 33 and an outside bowl surface 34. The toilet also has a toilet seat 35 with an underside 36 and topside 37 (not shown). The splash guard 10 comprises a pliable shield 11 having a major (upper) opening 19 on its top side that is defined by major edge 14, and further having a minor (lower) opening 12 that is defined by minor edge 13. The major edge 14 is associated with a resilient (or elastic) element 15. The resilient element 15 gathers the edge 14 of the pliable shield to a size smaller than its ungathered size as shown in FIG. 1. The resilient element 15 is stretchable to a size large enough to accept the bottom side 36 of the toilet seat 35 and then recoil over the top side 37 of the toilet seat so as to adhere itself to the toilet seat 35, such that the top side of the pliable shield 11 faces the bottom side 36 of the toilet seat 35. See FIG. 2. Although the resilient element 15 is shown in FIG. 1 as engaging the entire circumference (edge 14) of the major opening 19, it is also within the scope of the present invention that the resilient element be in proximity to 70% or more of the major opening. Thus, in an alternative embodiment (not shown), the resilient element is not present along the portion of the major edge 14 that would abut the toilet seat hinges when mounted. Once the splash guard 10 is mounted to the underside 36 of the toilet seat 35, the plunger handle 21 is inserted sequentially through the minor opening 12 and then the major opening in the pliable shield 11 of the splash guard 10 so that the plunger handle is on the top side of the splash guard 10 and the plunger bulb 22 is on the bottom (toilet bowl) side of the splash guard 10. See FIG. 2. As the toilet seat 35 is lowered to cover the top rim 32 of bowl 40, the substantially circumferential drape member 18, having bottom edge 17, hangs down and positions itself along the inside rim 31 of the toilet bowl 40 so as to shield the inside rim 31 from water 38 and any solid waste 39 that may be splashed up during plunging. Because water 38 and waste 39 in the toilet bowl 40 is prevented from hitting the inside rim 31 at the top of the toilet bowl 40, the water and waste cannot reach the top rim 32 so as to possibly roll over the top rim 32 and down outside rim 33 and outside bowl surface 34 onto the floor 70.

FIG. 2 discloses a view of the above described splash guard 10 of the present invention operatively positioned on a toilet seat 35. In its operative position with the toilet seat 35 in the down position, the resilient element 15 is seen as overlapping a substantial portion of the upper surface 37 of toilet seat 35 so as to hold the top surface of the pliable shield 11 against the bottom surface (or underside) 36 of toilet seat 35. Also when the splash guard 10 is operatively positioned on the toilet seat 35 and the toilet seat 35 is in the down position, drape member 18 circumferentially drapes over the inner rim 31 of the toilet bowl 40, thereby preventing splashes of water and waste from having access to the top rim 32, which in turn prevents splashed water and waste from having the ability to flow down the outside bowl surface 34 and onto the floor 70. When the plunging is complete, one need only lift the plunger handle 21 until the plunger bulb contacts the toilet side surface of the pliable shield 11. Further lifting of the plunger handle 21 will stretch the resilient element 15 until the large opening 19 increases in size to disengage the splash shield 10 from the lowered toilet seat 35. The removed splash guard 10 then may be placed in a waste receptacle (not shown) and safely discarded.

FIG. 3 is a drawing of an alternate and preferred embodiment of the splash guard of FIGS. 1-2. In FIG. 3, the splash guard 50 has a tear strip 60 that allows enlargement of the minor opening 52 beyond the size of the plunger bulb for separation of any plunger from the splash guard 50 on the clean (top) side of the splash guard 50. In the absence of the tear strip 60, the plunger 20 most often would be separated from a used splash guard 50 by pushing the plunger handle (not shown) back down through the minor opening 52, or by lifting the used splash guard 50 over the clean upper portion of the plunger handle (not shown). A problem with this operation contamination. Specifically, when the plunger handle is pushed back through the minor opening 52, the plunger handle goes from the clean (top) side of the splash guard to the soiled and wet underside of the splash guard where the upper portions of the otherwise clean plunger handle become contaminated with the splashed contents of the plugged toilet. The tear strip 60, which provides for the optional enlargement of minor opening 52, eliminates the above described problem.

Thus, in another embodiment, the present invention is directed to a splash guard 50 as shown in FIG. 3 comprising a pliable shield 51 having a major (upper) opening 59 on its top side that is defined by major edge 54, and further having a minor (lower) opening 52 that is defined by minor edge 53. The major edge 54 is associated with a resilient (or elastic) element 55. The resilient element 55 gathers the edge 54 of the pliable shield to a size smaller than its ungathered size and forming the major (upper) opening 59. In FIG. 3, the resilient element 55 is shown as positioned proximal to the entire circumference of the major opening 59. However, it is also within the scope of the present invention that the resilient element 55 not be totally circumferential. It is sufficient if the resilient element 55 is positioned proximal to 70% or more of the circumference of the major opening 59. In an alternative embodiment (not shown), the resilient element is absent along that portion of major edge 54 that would abut the toilet seat hinges when mounted. The splash guard 50 has drape member 58 having a top edge 56 and a bottom edge 57. The drape member 58 is attached via its top edge 56 to the bottom side of the pliable shield 51. In use, the resilient element 55 is stretchable to a size large enough to accept the bottom side of a toilet seat (as shown in FIG. 2) and then recoil over the top side of the toilet seat so as to adhere itself to the toilet seat, such that the top side of the pliable shield 51 faces the bottom side of the toilet seat. Once the splash guard 50 is mounted to the underside of the toilet seat (as per FIG. 2), the plunger handle is inserted sequentially through the minor opening 52 and then the major opening 59 in the pliable shield 51 so that the plunger handle is on the top side of the pliable shield 51 of the splash guard 50 and the plunger bulb (not shown) is on the bottom (toilet bowl) side of the splash guard 10. After use, the plunger handle is lifted up and it pulls on the pliable shield 51 which in turn stretches the resilient element 55 to a size greater than the toilet seat, thereby releasing the splash guard from the toilet seat. After use, the used splash guard 50 and plunger (not shown) can be placed over a waste receptacle (not shown) and the tear strip 60 engaged to tear along its length thereby enlarging minor opening 52 to a size large enough to allow the used splash guard 50 to drop away from the plunger head (not shown) and into the waste receptacle (not shown). Preferably, the tear strip 60 is associated with a tab 61 for ease in initiating the tear. While the tab 61 for the tear strip 60 is shown in FIG. 3 as being at the distal end of the tear strip 60 relative to the minor opening 52, it may optionally be proximal (not shown) to the minor opening 52 such that when the tab is pulled, the plunger handle acts to provide opposing pressure relative to the direction of pull and facilitates tearing the pliable shield 51 along tear strip 60. It is within the scope of the present invention that the tab 61 alone be colored, or that the tab 61 and tear strip 60 in combination be colored to be readily observable when required for use.

Figure 4:
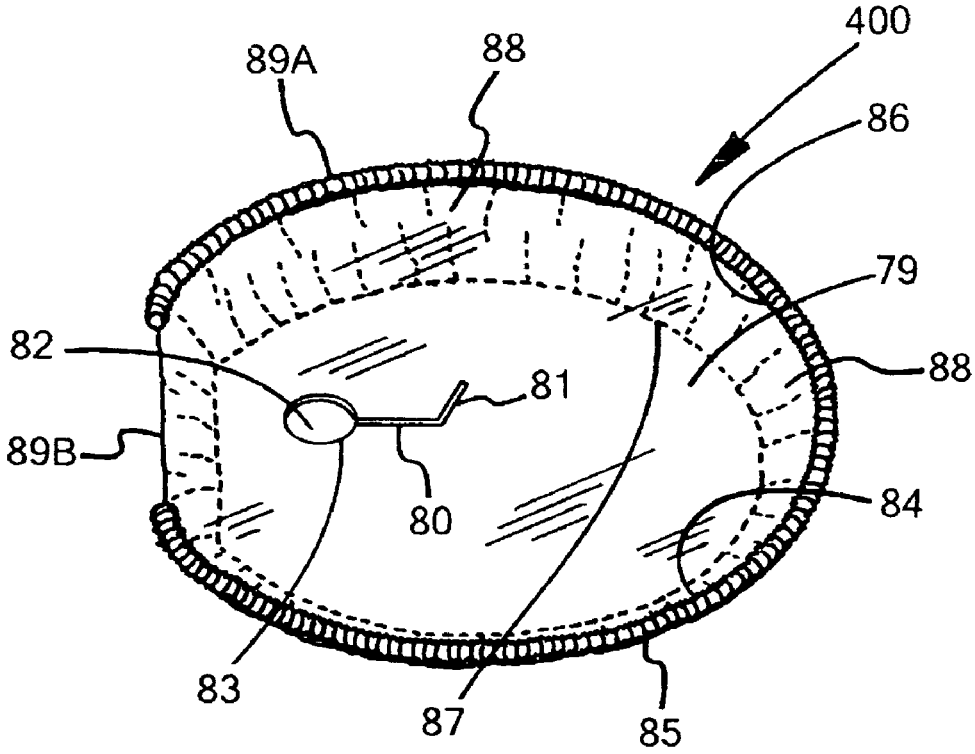
FIG. 4 depicts an oblique topside view of yet another embodiment of the splash guard of the present invention wherein an upper shield, which has a minor opening therein for receiving a plunger handle, is joined at a seam along its peripheral edge to the top edge of a draping member, wherein the front and lateral portions of the seam (89A) are in operative contact with a resilient element 85.

FIG. 4 depicts a splash guard 400 that mounts to the underside of a toilet seat on a flush toilet in need of plunging. The splash guard 400 of FIG. 4 comprises a substantially ovular pliable shield 79. By "substantially ovular" is meant that the pliable shield is oval-shaped or egg-shaped and having a blunted posterior end that corresponds to the blunted hinge region found at the posterior end of a toilet seat. Thus, the overall shape of the pliable shield mimics the shape of a conventional toilet seat albeit somewhat (5% to 20%) larger. The pliable shield 79 has a circumferential peripheral edge 84. The peripheral edge 84 is associated with a seam 89 wherein it is bound to the top edge 86 of drape member 88. In splash guard 400, seam 89 has two parts seam 89A and seam 89B. Specifically, seam 89B is located at the posterior end of the pliable shield 79 and joins the peripheral edge 84 of the pliable shield 79 to the top edge 86 of the drape member 88. Seam 89A not only joins the peripheral edge 84 of the pliable shield 79 to the top edge 86 of the drape member 88, it also incorporates a resilient element 85 for tensioning the edge 84 of the pliable shield 79 over the top of a toilet seat prior to plunging. Preferably, the resilient element 85 is tensioned before being incorporated into the seam 89A. Suitable resilient elements include rubber bands, elastic bands or elastic strings. The top edge 86 of the drape member 88 may be gathered or ungathered when attached to the seam. Preferably, it is gathered. The pliable shield 79 also has a minor opening 82 defined by edge 83 that is sized and shaped as already discussed herein for allowing the elongated handle of a plunger to move up and down during plunging. See e.g., FIG. 2. Typically, the minor opening 82 is centrally positioned in the posterior ½ to ⅓ of the pliable shield 79 so as to be positioned over the deepest part of a toilet bowl to facilitate plunging. Optionally, the edge 83 of minor opening 82 may frictionally engage the elongated handle of the plunger to form a loose seal to prevent splashed water and material from being ejected through the opening during vigorous plunging. Typically, when the minor opening is circular, the diameter of the minor opening ranges from ½ inch to 1.5 inches. To use the splash guard 400 of FIG. 4, a plunger bulb is first inserted into the bottom of a toilet bowl as shown in FIG. 2. Then, with the toilet seat in the up position, the splash guard of FIG. 4 is positioned over the elongated handle of the plunger and the splash guard is pushed down such that the minor opening 82 sides down the plunger handle. The splash guard is opened up such that the blunt posterior end and seam 89B is positioned toward the posterior hinge end of the toilet seat. Then, with the toilet seat in a half-way up position and with the splash guard 400 on the under side of the toilet seat, the pliable shield 79 is then stretched open and elasticized seam 89A is stretched outwardly and then over the top edges of the toilet seat whereupon the applied tension is released. The release of applied tension allows seam 89A to contract over the top edge of the toilet seat thereby mounting the splash guard 400 to the toilet seat. In the mounted position, the top surface of the pliable shield 79 is pressed against the bottom side of the toilet seat thereby shielding it while the drape member 88 hangs down. Upon further lowering the toilet seat, the hanging drape member 88 is then tucked into the toilet bowl such that its bottom edge 87 hangs down over the top rim of the toilet bowl and prevents water and waste from being ejected over the rim during plunging. When mounted on a toilet seat as described above, the splash guard 400 would outwardly appear as shown in FIG. 2. Examples 1-3 below provide dimensions and three methods for making 3 embodiments of the pliable shield and drape member of splash guard 400.

Preferably, in splash guard 400 of FIG. 4, the minor opening 82 is associated with a tear strip 80 and a tear tab 81. The tear strip 80 may include a perforation and may run in any direction from the minor opening. Only a single direction is shown in FIG. 4. The function of the tear strip is to allow for the sanitary separation of a used splash guard from its plunger. In practice, the used splash guard and plunger are lifted from the unclogged toilet as a single unit and placed over a sanitary waste receptacle. The tear tab 81 is pulled to tear open tear strip 80 thus enlarging the minor opening 82 to a size larger than the plunger bulb such that the used splash guard 400 drops away from the plunger bulb and into the waste receptacle. The size, structure and optional color of the tear strip and tear tab are as already discussed herein.

Thus, in another embodiment, the present invention is directed to a splash guard for containing the contents of a toilet having a toilet bowl, a rim, and a toilet seat, during plunging said toilet bowl with a plunger having an elongated handle and a plunger bulb, comprising: a substantially ovular pliable shield having a top side, a bottom side, a peripheral edge and a blunted posterior end, the pliable shield having a size from 5-20% greater than the size of said toilet seat; a drape member having an upper edge, a bottom edge, and a distance between the upper edge and the bottom edge of 3 to 8 inches; and a resilient element; the top edge of the drape member circumferentially affixed to the peripheral edge of the pliable shield at a seam, the resilient element being tensioned and operatively affixed along the length of the seam but optionally the elastic element not being affixed to the seam at the blunted end; the pliable shield further having a minor opening sized and positioned for slideably receiving a plunger handle, whereby when the splash guard is positioned on the underside of the toilet seat and the resilient element is stretched outwardly, and then upwardly to engage the top of the toilet seat, the top of the pliable shield covers the bottom of the toilet seat and is held in position by the tension in the resilient member, and when the toilet seat is in the down position, the drape member drapes down sufficiently into the toilet bowl and in proximity to the rim so as to shield the rim from receiving splashes or waste during plunging with the plunger.

Figure 5:
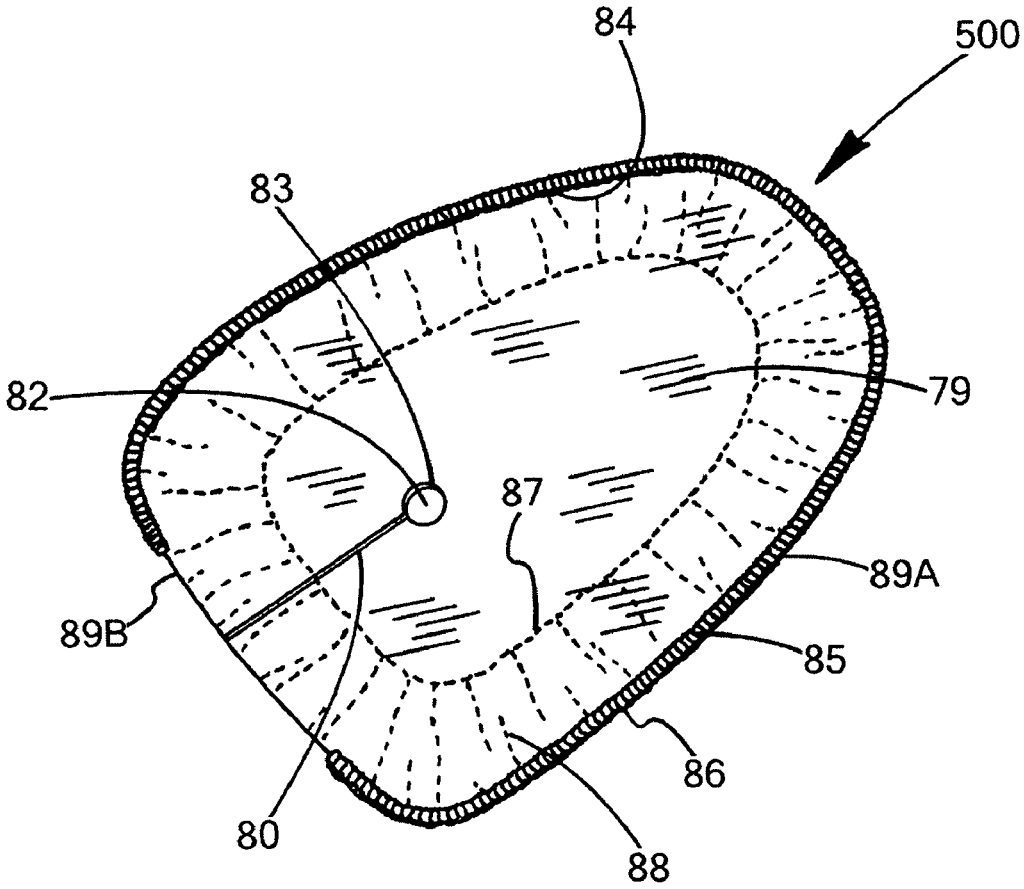
FIG. 5 is a topside view of an alternate embodiment of a splash guard of the present invention wherein the tear strip 80 (typically, a perforation) is between minor opening 82 and the (rear) seam 89B, and the drape member 88 is made from an oval-shaped strip of pliable, water-proof material.

Two embodiments of splash guards falling within the scope of the above described paragraph are shown in FIGS. 4 and 5 herein and are made as exemplified in Examples 1-3. The major difference in the three examples is how the drape member 88 is cut from a water resistant film, typically from one of the plastic films described herein. The cut of the drape member affects the angle that the drape member hangs from the seam, but not its function. In Example 1, the inside angle between the drape member and the pliable shield is most acute. In Example 3, the inside angle between the drape member and the pliable shield would be the least acute. The structure of the drape member also affects the manufacturing process, particularly the seaming process. It is believed that the splash guard made with the blunted ovular drape member described in Example 1 is the least complex to manufacture. However, all the splash guards described in the examples will operatively mount to the underside of a toilet seat to provide a sanitary shield that prevents water and waste from being discharged from a toilet bowl during plunging.

EXAMPLE 1

Dimensions for a First Embodiment of Splash Guard 500 of FIG. 5

From a 1 mil thick sheet of clear polyethylene, a blunted oval is cut having the minor diameter of 460 mm and the major diameter of 530 mm. The length of the blunted edge at the posterior end is 180 mm. This blunted oval sheet corresponds to pliable shield 79 of FIG. 5. The blank for the drape member 88 is cut out of a 1 mil thick sheet of polyethylene as a blunted oval having a small diameter of 520 mm and a large diameter of 590 mm. The length of the blunted edge is 180 mm. Then, the drape member blank has a smaller blunted oval cut out of its center such that the raw drape member 88 resembles a blunted letter "O". In this embodiment, the top edge 86 of the drape member 88 is the outside edge of the oval and has a greater circumference than the bottom edge 87 which is the inside edge of the drape member. This blunted "O" structure for the raw drape member 88 is a blunted ovular strip that lies flat and facilitates its outer edge being gathered, matched and affixed to the peripheral edge 84 of the flat pliable shield 79 to form a seam 89. A resilient element 85 is preferably affixed to a substantial portion of the seam 89 at the same time as the gathered top edge 86 of the drape member 88 is affixed to the peripheral edge 84 of pliable shield 79. The portion of seam 89 that incorporates the resilient element 85 is designated 89A and the portion of the seam that lacks the resilient element 85 is designated 89B. Preferably, the resilient element 85 is tensioned before being affixed. As shown in FIG. 5, the seam portion 89B lacking the resilient member is at the posterior (blunted) portion of the splash guard. However, it is within the scope of the present invention that any small portion of the seam 89 may lack incorporating the resilient element so long as at least a majority (major portion) of the seam 89 does incorporate the resilient element to form seam portion 89A incorporating the resilient element.

EXAMPLE 2

Dimensions for an Embodiment of Splash Guard 400 of FIG. 4

From a 1 mil thick sheet of clear polyethylene, an oval is cut having the minor diameter of 700 mm and the major diameter of 790 mm. This first cut piece comprises the raw form of both the clear pliable shield and the drape member. From the center of the first cut piece, a blunted oval is cut out having the minor diameter of 460 mm and the major diameter of 530 mm. This center cut piece constitutes the clear pliable shield 79 and the outer "O" shaped piece constitutes the drape member 88. The "O" shaped raw drape member has a wall thickness (ultimately drape length) of about 120 mm at its anterior and lateral sides and a wall thickness from about 140-160 mm at its posterior walls. About 190 mm from the blunted posterior end of the pliable shield, a minor opening of ½ inch (12 mm) diameter is centrally cut or punched. To make this embodiment of the splash guard 400, the peripheral edge 84 of the pliable shield 79 is attached to the inner (ultimately top) edge 86 of the raw drape member 88 to form a seam 89, wherein the portion of the seam designated 89A (see FIG. 4), constituting the side and anterior edges of the pliable shield, incorporate a tensioned resilient band. In this assembled embodiment, the drape member 88 has a length of about 120 mm along the anterior and lateral edges of the resulting splash guard.

EXAMPLE 3

Dimensions for a Second Embodiment of Splash Guard 400

In this embodiment, the pliable shield and drape member are made from a single piece of 1 mil thick clear polyethylene film. From a 1 mil thick sheet of clear polyethylene, an oval is cut having the minor diameter of 700 mm and the major diameter of 790 mm. About 120 mm in from the outside lateral and anterior edges of the oval, a tensioned elastic band is sewn or affixed to the polyethylene film to create a tensioned seam 89A. About 250 mm from the blunted posterior end of the pliable shield, a minor opening of ½ inch (12 mm) diameter is centrally cut or punched. In this embodiment, the bottom edge 87 of the drape member 88 (which is outermost on the oval) has a longer circumference than the top edge 86 of the drape member along the seam 89. However, regardless of the length of the bottom edge of the drape member, the drape member of this embodiment, like all embodiments described herein, hangs sufficiently into the bowl so as to prevent water and waste from contacting the top rim of the toilet bowl, and thus overflowing, during plunging.

The invention claimed is:

1. A splash guard for containing the contents of a toilet having a toilet bowl, a rim, and a toilet seat, during plunging said toilet bowl with a plunger having an elongated handle and a plunger bulb, comprising: a substantially ovular pliable shield having a top side, a bottom side, a peripheral edge and a blunted posterior end, said pliable shield having a size from 5-20% greater than the size of said toilet seat; a drape member having an upper edge, a bottom edge, and a distance between said upper edge and said bottom edge of 3 to 8 inches; and a resilient element; the top edge of the drape member circumferentially affixed to the peripheral edge of the pliable shield at a seam, said resilient element being tensioned and operatively affixed along the length of said seam but said elastic element not being affixed across the seam at said blunted end; said pliable shield further having a minor opening sized and positioned for slideably receiving a plunger handle, whereby when the splash guard is positioned on the underside of the toilet seat and the resilient element is stretched outwardly, and then upwardly to engage the top of the toilet seat, the top of the pliable shield covers the bottom of the toilet seat and is held in position by the tension in the resilient member, and when the toilet seat is in the down position, the drape member drapes down sufficiently into the toilet bowl and in proximity to said rim so as to shield the rim from receiving splashes or waste during said plunging with said plunger handle having inserted through the minor opening from the bottom side of said shield.

2. The splash guard of claim 1, wherein the pliable shield comprises a polymeric film.

3. The splash guard of claim 2, wherein the polymeric film is clear.

4. The splash guard of claim 2, wherein the polymeric film is selected from the group consisting of polyethylene, polypropylene, and a combination thereof.

5. The splash guard of claim 2, wherein the drape member has a length within the range of 4 to 8 inches.

6. The splash guard of claim 5, wherein the drape member has a length within the range of 4 to 6 inches.

7. The splash guard of claim 3, wherein the resilient member is selected from the group consisting of a rubber band, an elastic band and an elastic string.

8. The splash guard of claim 5, wherein the drape member is attached to the peripheral edge of the pliable shield by heat sealing.

9. The splash guard of claim 5, wherein the drape member is attached to the underside of the pliable shield by ultrasonic welding.

10. The splash guard of claim 1, wherein the pliable shield further comprises a tear strip that is in substantial proximity to said lower opening.

11. The splash guard of claim 10, wherein the tear strip is in contact with said minor opening.

12. The splash guard of claim 10, wherein the tear strip is associated with a tear tab.

13. The splash guard of claim 10, wherein said tear strip is at least 3 inches long.

14. The splash guard of claim 13, wherein said tear strip is within the range of 3.5 to 8 inches long.

15. The splash guard of claim 1, wherein said minor opening is in the posterior ½ to ⅓ of said shield.

16. A splash guard of claim 1, wherein the minor opening has a shape selected from the group consisting of a slit, an oval, an ellipse and a circle.

17. The splash guard of claim 16, wherein the minor opening has a shape selected from the group consisting of an oval, an ellipse and a circle.

18. The splash guard of claim 17, wherein the lower opening has the shape of a circle.

19. The splash guard of claim 18, wherein the minor opening is a circle having a diameter within the range of 0.5 inches to 1.5 inches.

20. The splash guard of claim 2, wherein the polymeric film has a thickness within the range of 0.5 to 5 mils.

* * * * *